US006347597B1

(12) United States Patent
Chen

(10) Patent No.: US 6,347,597 B1
(45) Date of Patent: Feb. 19, 2002

(54) FLAT SEWING DEVICE WITHOUT THREAD BOBBINS

(76) Inventor: Jung Kuang Chen, 3F, No. 15, Alley 2, Lane 219, Hsin Ming Rd., Neihu District, Taipei (TW)

( * ) Notice: Subject to any disclaimer, the term of this patent is extended or adjusted under 35 U.S.C. 154(b) by 0 days.

(21) Appl. No.: 09/747,995

(22) Filed: Dec. 27, 2000

(51) Int. Cl.[7] ..... D05B 57/10
(52) U.S. Cl. ..... 112/185
(58) Field of Search ..... 112/185

(56) References Cited

U.S. PATENT DOCUMENTS 1,119,561 A * 12/1914 Zahn ..... 112/232
3,066,624 A * 12/1962 Jeppner ..... 112/185
5,199,365 A * 4/1993 Arnold ..... 112/273
5,842,431 A * 12/1998 Wu ..... 112/232

* cited by examiner

*Primary Examiner*—Andy Falik
(74) *Attorney, Agent, or Firm*—Rosenberg, Klein & Lee

(57) ABSTRACT

A flat sewing device without bobbins is provided that includes an oblong case, a plurality of gears, shuttle casing, a shuttle, and a large spool of sewing thread. The gears are connected with one another to rotate the shuttle. A pinion rotated by a driving spindle rotatably engages a driving gear. The driving gear rotatably drives a second pinion mounted on a hollow driving axial rod. The hollow driving axial rod is coupled to the shuttle and the sewing thread passes through the hollow driving axial rod.

5 Claims, 6 Drawing Sheets

FLAT SEWING DEVICE WITHOUT THREAD BOBBINS

FIELD OF THE INVENTION

The present invention relates to a flat sewing device without thread bobbins, and especially to a flat sewing device used in a sewing machine.

BACKGROUND OF THE INVENTION

Referring to FIG. 1, the shuttle flat sewing device in the prior art is illustrated. The shuttle flat dewing device is installed on a sewing machine 50. The shuttle receiving groove 503 is installed below the sewing portion 501 of the sewing machine 50. A driving spindle 502*a* is installed at the center of the shuttle receiving groove 503. The driving spindle 502*a* is connected to a shuttle casing 502*b*. The shuttle casing 502*b* is extended with a shuttle receiving cavity 503. The shuttle casing 502*b* can be disposed in the shuttle receiving seat 502. The center of the shuttle receiving cavity 503 is installed with an axial rod 504. The edge of the axial rod 504 is installed with an annular groove 504*a*. The edge of the shuttle receiving cavity 503 is installed with a positioning notch 505. A lateral side of the sewing portion 501 of the sewing machine 50 is installed with a notch 506. Two sides of the notch 506 each are installed with a sliding track 507. A cover 508 can slide in the sliding track 507. A hollow shaft 61 extends from the interior of the shuttle 60. The outer lateral side thereof is installed with a movable elastomer 62 and a positioning rod 63. A press 64 extends from an outer edge of the shuttle 60. A thread bobbin 70 is further installed within the shuttle 60. A sewing thread 71 is wound around the interior of the thread bobbin 70.

Referring to FIGS. 1 and 2, as the sewing machine 50 is to be assembled, at first, the sewing thread 71 is wound around the thread bobbin 70. At the press 64, at the outer edge of the shuttle 60, the sewing thread protrudes out from the thread bobbin 70. The thread bobbin 70 is placed within the shuttle so that the central hole of the thread bobbin 70 is movably installed on the hollow shaft 61 in the shuttle 60. Then, the positioning rod 63 at the outer surface of the shuttle 760 is aligned with the notch 505 at an upper edge of the shuttle receiving cavity 503 in the shuttle receiving seat 502. Next, the shuttle 60 is installed in the shuttle receiving cavity 503 of the sewing machine 50 so that the hollow shaft 61 within the shuttle 60 is successfully installed in the shuttle receiving cavity 503 of the sewing machine 50. Then, the shuttle 60 is connected to an axial rod 504 at a center of the shuttle receiving cavity 503. The shuttle casing 502*b* is then connected to the driving spindle 502*a* at the center of the shuttle receiving seat 502. Finally, the cover 508 slides into the sliding tracks 507 at two sides of the notch 506 of the sewing machine 50.

However, since the length of the sewing thread 71 in the thread bobbin 70 is finite, the sewing length of the sewing thread 71 is equally finite. The sewing thread 70 must be replenished frequently for supplementing the sewing thread 71 in the thread bobbin 70. After the sewing thread 71 in the thread bobbin 70 is used up, in the sewing machine 50, the sewing thread 71 cannot be replenished immediately. The main thread of the sewing machine 50 will catch and break, and thus the thread must be rearranged at once. As a result, the efficiency of the sewing machine 50 is affected.

Moreover, since them material of the thread bobbin 70 is usually iron, and the sewing speed of the sewing machine 50 is very quick, the thread bobbin 70 is easily heated to a high temperature. When replenishing or supplementing the sewing thread 71 in the thread bobbin 70, the user must touch the thread bobbin 70 and may thereby be burned.

Moreover, since the thread bobbin 70 is easily heated to a high temperature, the worker generally wears gloves, but working under that condition is inconvenient.

SUMMARY OF THE INVENTION

Accordingly, the primary object of the present invention is to provide a flat sewing device without thread bobbins which is used with a large sewing thread supply, so as to increase the sewing length of the sewing machine. The sewing thread in a large spool need not be replenished frequently. The main thread of the sewing machine will not break frequently. Harm from burns is avoided since the worker does not have to touch a hot thread bobbin. Another object of the present invention is to provide a flat sewing device without thread bobbins.

To achieve these objects, the present invention provides a flat sewing device without thread bobbins. Therefore, it is unnecessary for a worker to touch a hot thread bobbin. The convenience of working with the present invention is an improvement as a worker need not wear a glove.

In order to achieve the aforesaid objects, the present invention provides a flat sewing device without thread bobbins comprising: a dynamic seat having screw holes at a front face thereof, and a driving spindle being installed at a lower edge near a center thereof; an oblong case having two inner sides each extending with a flange and being fixed to a front face of the dynamic seat by screws; an auxiliary seat, gears, spindle, rotary bearings, a hollow spindle, a hollow driving spindle, which are properly connected; and a shuttle casing extending with a receiving cavity. The thread is not frequently broken. The work of changing color can be accomplished successfully. It is unnecessary to detach the shuttle or other elements. The problems of replenishing and supplementing the sewing thread are removed by the present invention, it is unnecessary to frequently replenish the sewing thread. Thus, the performance of the sewing machine is improved.

The various objects and advantages of the present invention will be more readily understood from the following detailed description when read in conjunction with the appended drawings.

DETAILED DESCRIPTION OF THE PREFERRED EMBODIMENTS

Figure 1:
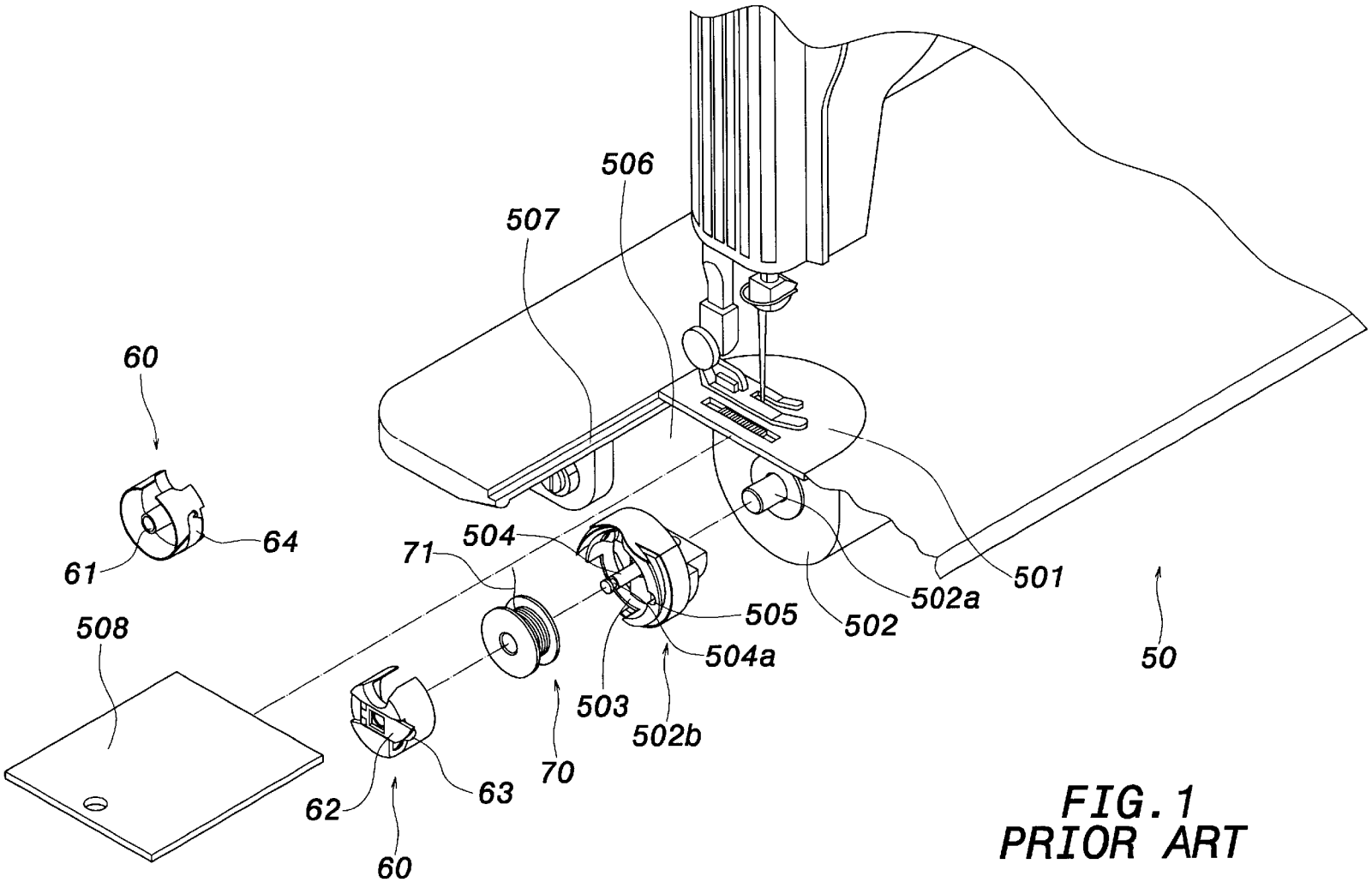
FIG. 1 PRIOR ART
FIG. 1 is an exploded perspective view of the shuttle flat sewing device in a prior art sewing machine.
Figure 2:
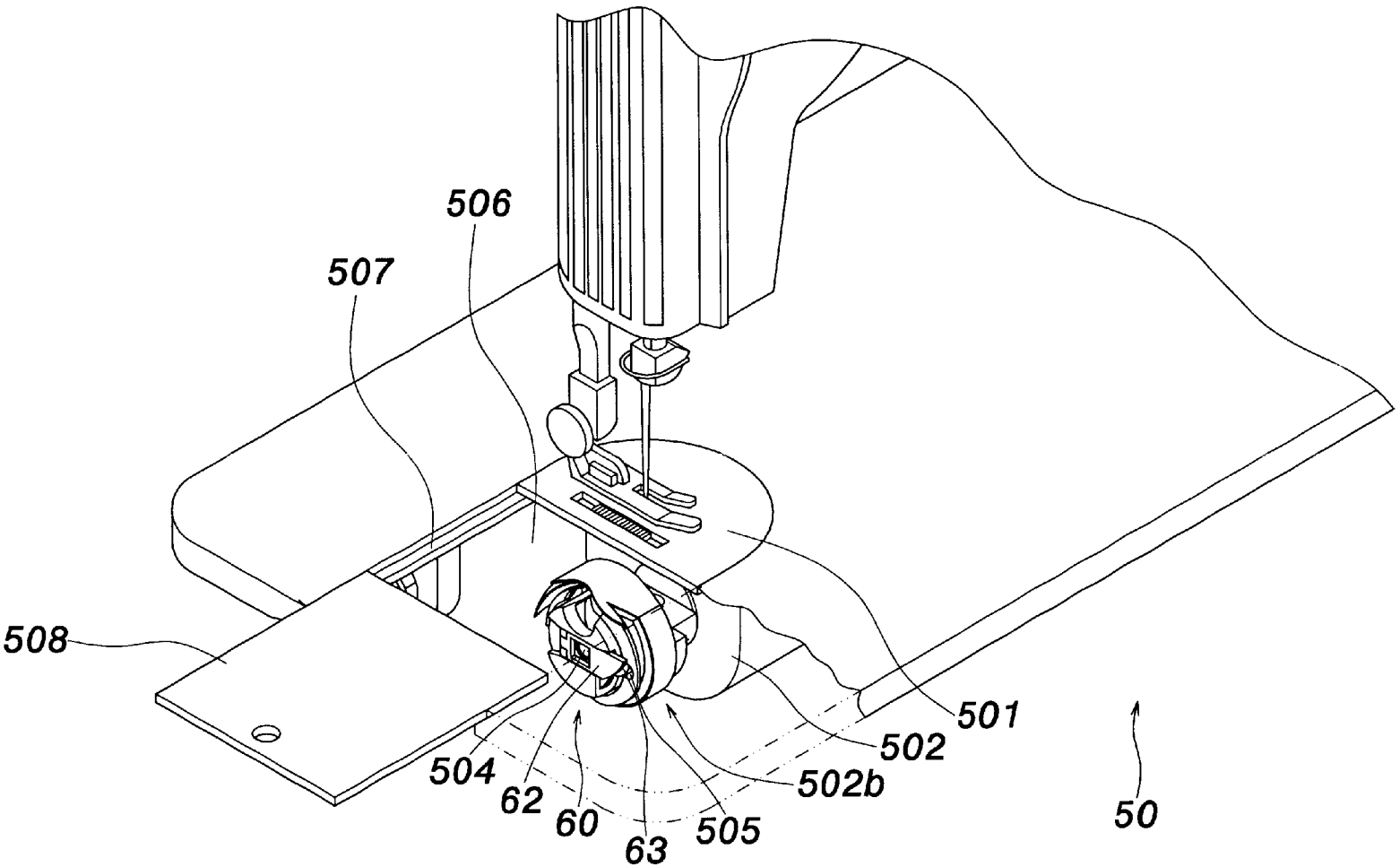
FIG. 2 PRIOR ART
FIG. 2 is a perspective view of an assembled shuttle flat sewing device in a prior art sewing machine.
Figure 3:
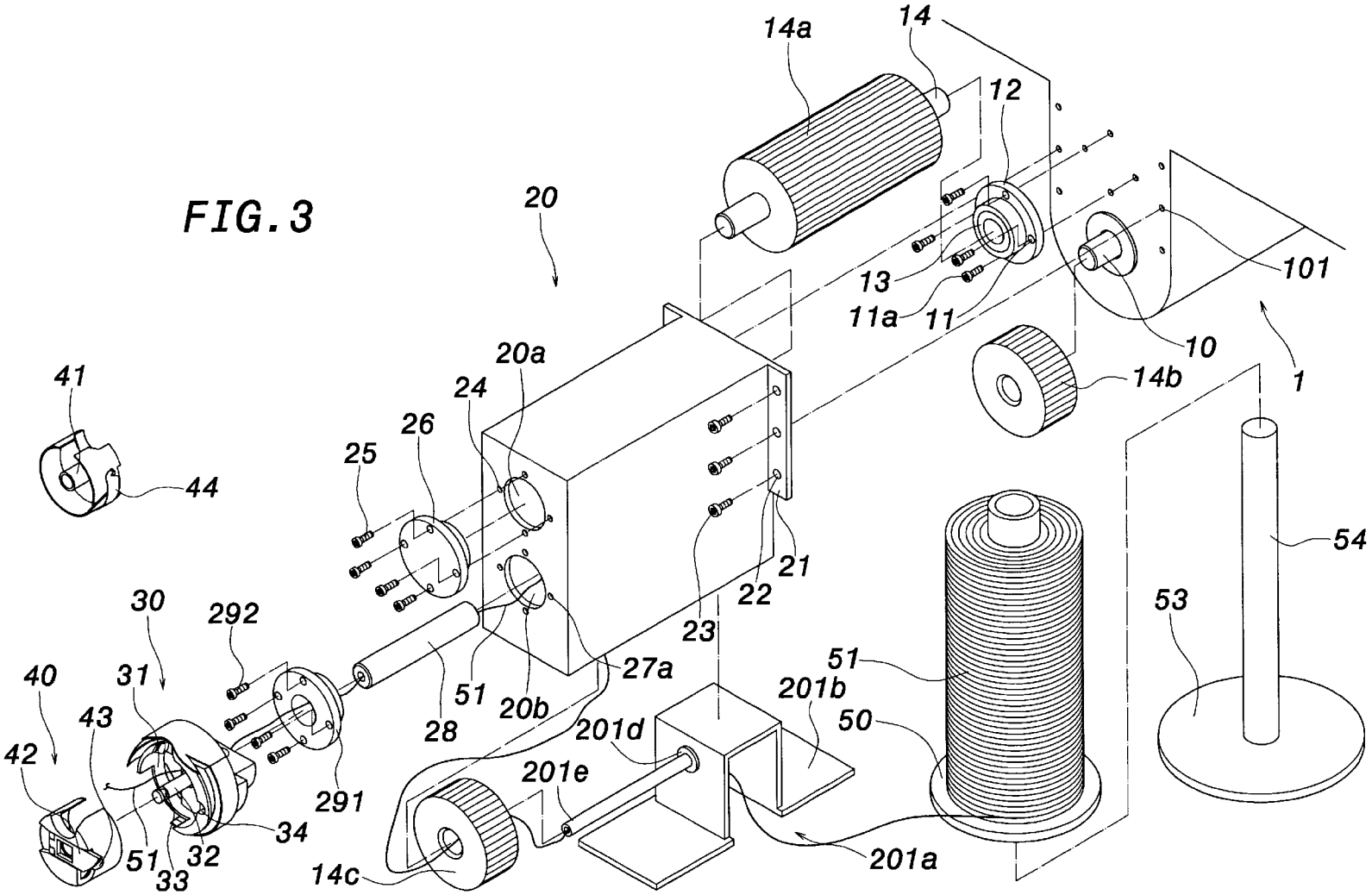
FIG. 3 is an exploded perspective view of a sewing thread supply and flat sewing device of the present invention.
Figure 5:
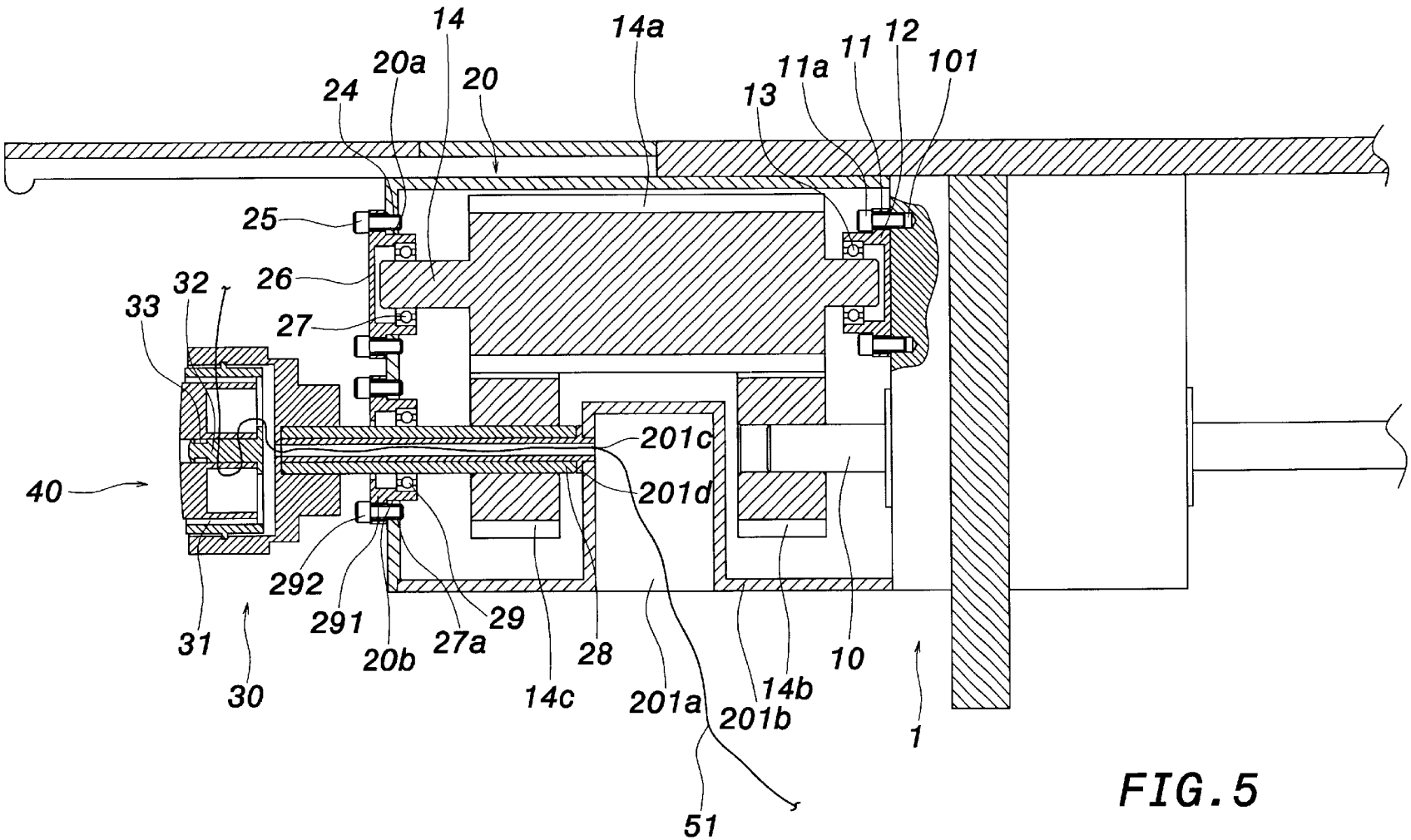
FIG. 5 is a cross sectional view of the present invention showing the path of the sewing thread.

Referring to FIGS. 3 and 5, a flat sewing device is shown that is used with a sewing machine. The structure includes a dynamic seat 1. A driving spindle 10 is installed at the lower edge of the dynamic seat 1 and near the center portion thereof. A plurality of screw holes 101 is formed in the dynamic seat 1. Screws 11*a* respectively pass through the screw holes 11 of a retaining seat 12. The retaining seat 12 supports the rotary bearing 13. The rotary bearing 13 serves to rotatably support a spindle 14. The spindle 14 passes through a driving gear 14*a*. The driving gear 14*a* serves to drive a pinion 14*b* and 14*c*. An oblong case 20 is also included. An auxiliary seat 201*a* is installed in the oblong case 20. The lower end of the auxiliary seat 201 extends with flat plates 201*b*. A front side of the auxiliary seat 201*a* has an opening 201*c* formed therein.

A pad 201*d* is connected with the opening 201*c*. The pad 201*d* passes through the hollow spindle 201*e*. One end of the hollow spindle 201*e* is connected to the pinion 14*c*. Two sides f the oblong case 20 are formed with respective flanges 21 extending therefrom. Each flange 21 is installed with a plurality of screw holes 22. By the screw holes 22, the oblong case 20 is fixed to the dynamic seat 1 by screws 23. An outer front face of the oblong case 20 is formed with an opening 20*a* and an opening 20*b*. The periphery of the opening 20*a* is formed with a plurality of screw holes 24. By means of screws 25 extending through the screw holes 24 the retaining seat 26 is locked to the oblong case 20. The retaining seat 26 is connected to a rotary bearing 27. The rotary bearing 27 rotatably supports one end of the spindle 14.

The periphery of the opening 20*b* is also formed with a plurality of screw holes 27*a* formed therein. A hollow driving axial rod 28 is mounted in the center of the opening 20*b*. The hollow spindle 201*e* passes through the hollow driving axial rod 28. One end of the driving axial rod 28 is connected to the pinion 14*c*, and another end is connected to the rotary bearing 29. The rotary bearing 29 is connected to the retaining seat 291. The driving axial rod 28 passes through an protrudes out of the retaining seat 291. The retaining seat 291 is fixed to oblong case 20 by screws 292 extending through screw holes 27*a* at the periphery of the opening 20*b*.

The driving axial rod 28 protruding from the retaining seat 291 passes through and is connected with a shuttle casing 30. The shuttle casing 30 is formed with a shuttle receiving cavity 31. The shuttle receiving cavity 31 has an axial rod at its center. The distal end portion of the axial rod 32 has an annular groove 33 formed therein. The peripheral edge of the shuttle receiving cavity 31 has a positioning notch 34 formed therein. The shuttle receiving cavity 31 serves to receive a shuttle 40. The interior of the shuttle 40 has a hollow shaft 41 extending therefrom, and an outer side of the shuttle 40 is mounted with a movable elastomer 42 and a positioning rod 43. The outer edge of the shuttle 40 is extended with a press 44. Furthermore, a large spool 50 is also provided. The large spool 50 is wound with sewing thread 51. The large spool 50 is placed on the auxiliary supporting rod 54 of a spool shaft seat 53.

Figures 4, 4A:
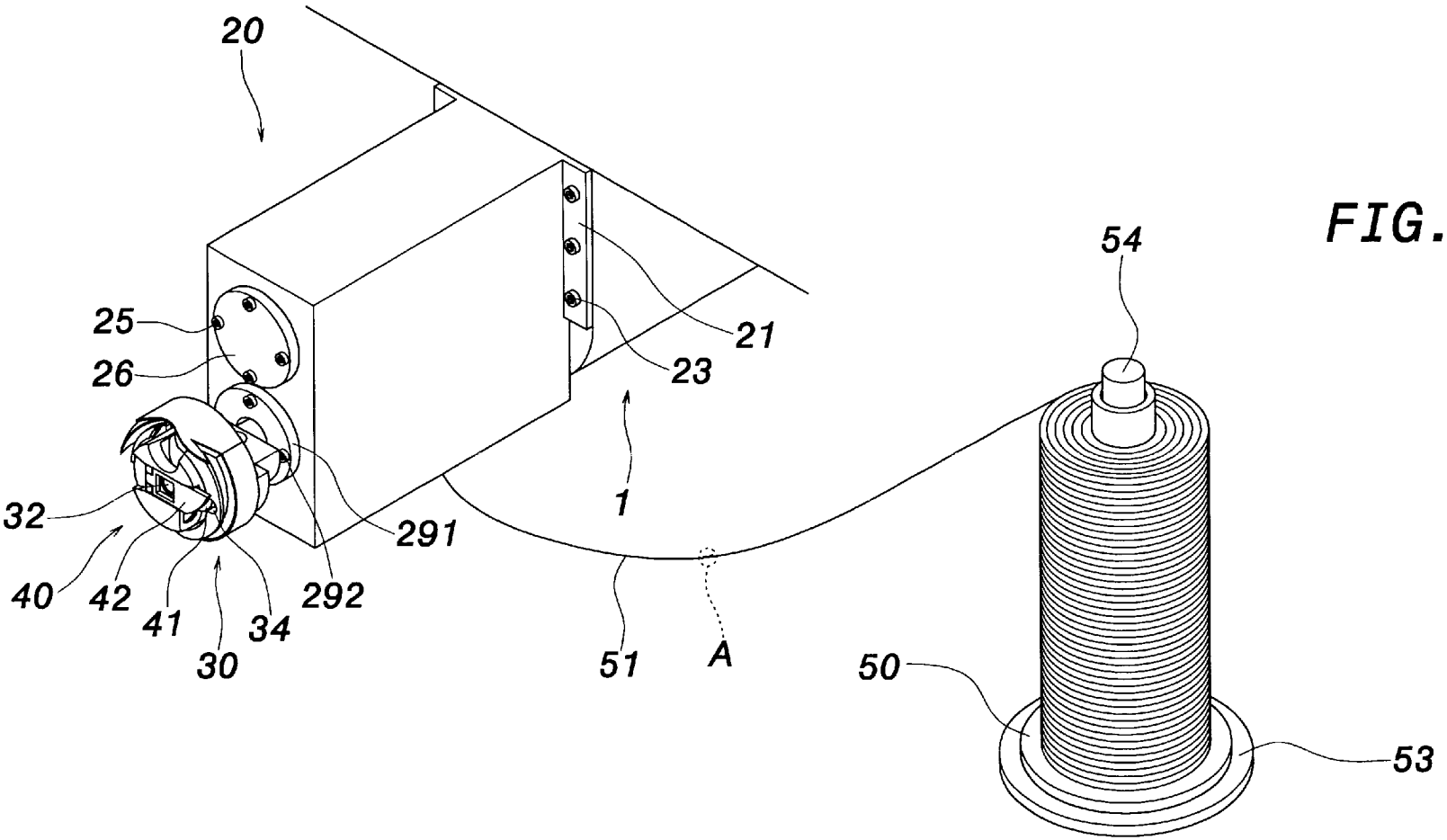
FIG. 4 is a perspective view of the assembled sewing thread supply and flat sewing device of the present invention.
FIG. 4A is a partial enlarged view showing the mounting of the shuttle of the present invention.

Referring to FIGS. 3, 4 and 5, the assembly of all the components will be described in the following paragraphs.

At first, the large spool 50 with the sewing thread 51 is placed on the auxiliary supporting rod 54 of the spool shaft seat 53. Then, the rotary bearing 13 connected to the retaining seat 12 is secured by locking the retaining seat 12 to the front face of the dynamic seat 1 by screws 11*a* passed through screw holes 11 and engaged in the screw holes 101. Then, the pinion 14*b* is connected to the driving spindle 10 at a lower portion of the dynamic seat 1 near the center thereof. Then, one end of the spindle 14 passes through the rotary bearing 13 connected to the retaining seat 12. The pinion 14*b* rotatably drives the driving gear 14*a* of the spindle 14 that is drivingly connected to the pinion 14*c*. The pinion 14*c* drives the driving axial rod 28, through which the spindle 201*e* passes.

After the sewing thread 51 passes through the hollow spindle 201*e* and the driving axial rod 28, the oblong case 20 covers the retaining seat 12, rotary bearing 13, spindle 14, driving gear 14*a*, pinion 14*b*, pinion 14*c*, auxiliary seat 201*a*, hollow spindle 201*e*, driving axial rod 28, and a portion of the sewing thread 51. Then, the plats 201*b* are connected to the lower end of the oblong case 20. Screws 23 pass through the screw holes 22 in the flanges 21 of the oblong case 20 to engage the screw holes 101 on the front face of the dynamic seat 1. Then, the rotary bearing 27 connected to the retaining seat 26 is connected to the end of the spindle 14 and then screws 25 pass through the retaining seat 26 for securement over the opening 20*a* at the front outer side of the oblong case 20. The driving axial rod 28 protruding from the opening 20*b* is supported in the rotary bearing 29 mounted in the retaining seat 291. Screws 292 secure the retaining seat to the screw holes 27*a* at the periphery of the opening 20*b*.

The driving axial rod 28, protruding from the retaining seat 292, and the hollow spindle 201*e* pass into the shuttle casing 30. Then, the shuttle receiving cavity 31 formed in the shuttle casing 30 receives the shuttle 40 therein. The axial rod 32 at the center of the shuttle receiving cavity 31 is placed into the hollow shaft 41 extending from the interior of the shuttle 40. The sewing thread 51 passes through the press 44 at an outer edge of the shuttle 40 to be tensioned thereby. Then a positioning rod 43 at the outer surface of the shuttle 40 is aligned with the positioning notch 34 of the shuttle casing 30, and the shuttle 40 is placed in the shuttle receiving cavity 31, to complete the assembly of all of the parts.

With reference to FIGS. 4, 4A and 5, just before the sewing thread 51, wound on the large spool 50, is used up, it is only necessary to wind the proximal end of the sewing thread 51 to the distal end of a sewing thread 51 on another large spool 50. By rotating the diving spindle 10 at the lower portion of the dynamic seat 1, the successive work can be completed successfully. Alternately, if it is desired to change the color of the sewing thread 51, it is only necessary to cut the current sewing thread 51, and then connect sewing thread 51 in the desired color thereto. Then, by rotating the driving spindle 10 at the lower portion of the dynamic seat 1, the work of changing color can be accomplished successfully, without detaching the shuttle 40 or other elements. The problem of replenishing and supplementing the sewing thread 51 is eliminated. Thus, the performance of the sewing machine is improved.

Figure 6:
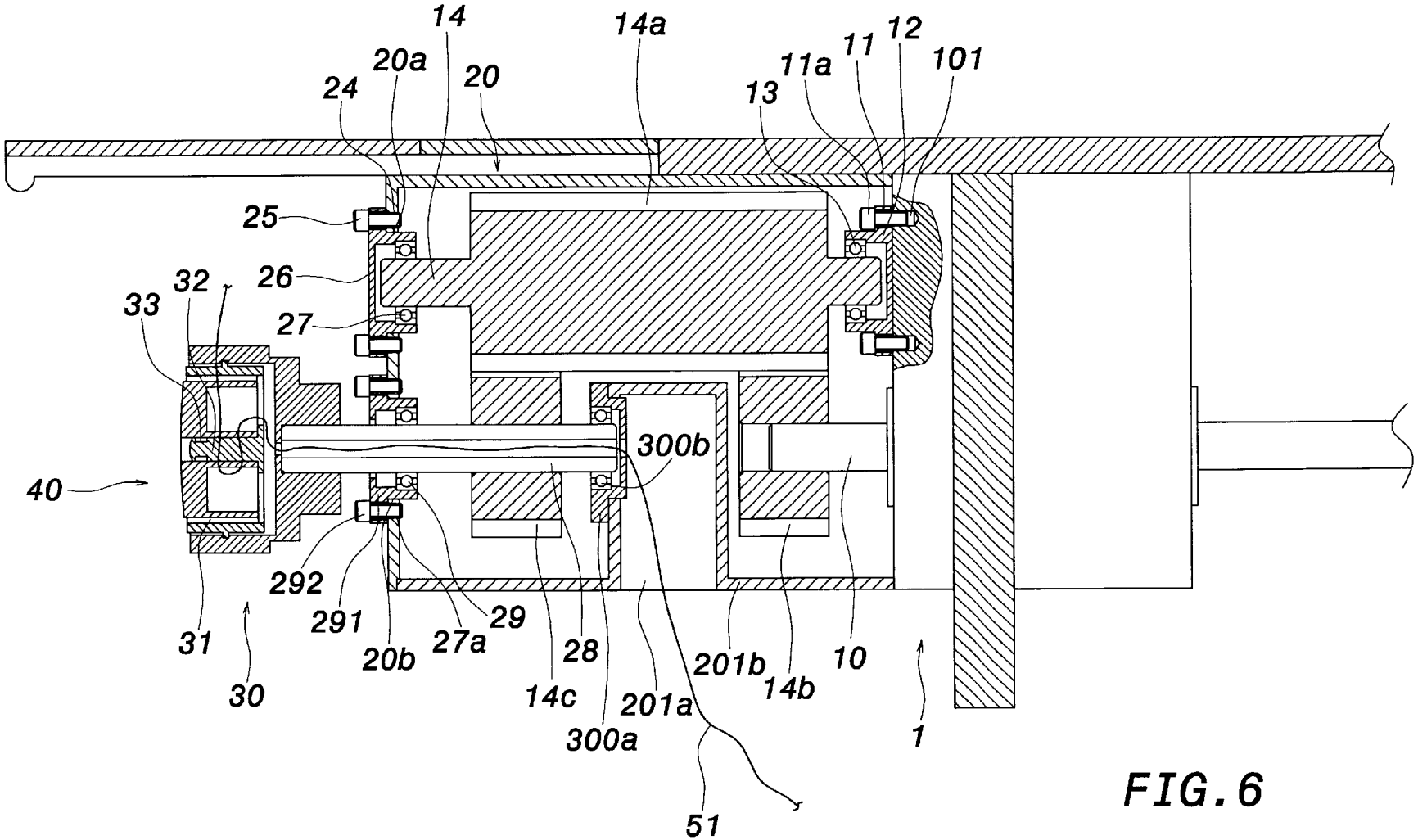
FIG. 6 is a cross sectional view of another embodiment of the present invention showing the path of the sewing thread.

Referring to FIG. 6, another embodiment of the present invention is shown. The driving axial rod 28 of the auxiliary seat 201*a* can be supported by a rotary bearing 300*b* mounted in a retaining seat 300*a*. Therefore, the hollow spindle 201*e* is unnecessary (referring to FIG. 3).

Although the present invention has been described with reference to the preferred embodiments, it will be understood that the invention is not limited to the details described herein. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A flat sewing device without bobbins, comprising:

a dynamic seat having screw holes formed in a front face thereof, and a driving spindle being disposed at a lower portion of the dynamic seat adjacent a center thereof;

an oblong case having two flanges extending from opposing sides thereof and being fixed to the front face of the dynamic seat by screws;

an auxiliary seat mounted in the oblong case;

a first pinion disposed in the oblong case and rotatably coupled to the driving spindle;

a driving gear disposed in the oblong case and mounted on a spindle supported by a pair of rotary bearings, the driving gear being engaged with the first pinion;

a second pinion disposed in the oblong case and mounted to a hollow driving axial rod, the second pinion being engaged with the driving gear to be rotatably driven thereby;

a shuttle casing coupled to the hollow driving axial rod and having a receiving cavity formed therein, the shuttle casing having an axial rod extending from a center portion of the receiving cavity, the axial rod having an annular groove formed adjacent a distal end thereof, the shuttle casing having a positioning notch formed in an edge thereof;

a shuttle having a hollow shaft extending from an interior thereof and being installed in the receiving cavity of the shuttle casing, the hollow shaft overlaying the axial rod, an outer side of the shuttle having a movable elastomer and a positioning rod, an outer edge of the shuttle being formed with a press which is disposed in the receiving cavity of the shuttle casing, and a large spool having a sewing thread wound thereon.

2. The flat sewing device without bobbins as claimed in claim 1, wherein the sewing thread passes through the hollow driving axial rod and into the shuttle casing.

3. The flat sewing device without bobbins as claimed in claim 1, wherein the large spool is positioned on a spool shaft seat.

4. The flat sewing device without bobbins as claimed in claim 3, wherein the spool shaft seat has an auxiliary supporting rod extending therefrom and passing through the large spool.

5. The flat sewing device without bobbins as claimed in claim 1, wherein the auxiliary seat has a hollow spindle extending through the hollow driving axial rod, the sewing thread passing through the hollow spindle.

* * * * *